US005141230A

United States Patent [19]

Antonious

[11] Patent Number: 5,141,230

[45] Date of Patent: * Aug. 25, 1992

[54] METAL WOOD GOLF CLUB HEAD WITH IMPROVED WEIGHTING SYSTEM

[76] Inventor: Anthony J. Antonious, 7738 Calle Facil, Sarasota, Fla. 34238

[ * ] Notice: The portion of the term of this patent subsequent to Apr. 2, 2008 has been disclaimed.

[21] Appl. No.: 565,473

[22] Filed: Aug. 10, 1990

[51] Int. Cl.[5] ..... A63B 53/04

[52] U.S. Cl. ..... 273/167 H; 273/169

[58] Field of Search ..... 273/167 R, 167 B-F, 273/167 H, 167 J, 169

[56] References Cited

U.S. PATENT DOCUMENTS

| | | | |
|---|---|---|---|
| 684,532 | 10/1901 | Vehslage | 273/169 |
| 863,728 | 8/1907 | Legh | 273/169 |
| 1,504,380 | 8/1924 | Reitenour | 273/169 |
| 1,526,438 | 2/1925 | Scott | 273/169 |
| 1,543,691 | 6/1925 | Beat | 273/169 |
| 1,549,993 | 8/1925 | Klin | 273/169 |
| 1,582,836 | 4/1926 | Link | 273/167 H |
| 1,605,551 | 11/1926 | Mattern | 273/169 |
| 1,658,581 | 2/1928 | Tobia | 273/169 |
| 1,901,562 | 3/1933 | Main | 273/169 |
| 2,087,685 | 7/1937 | Hackney | 273/167 F |
| 3,695,618 | 10/1972 | Woolley et al. | 273/169 |
| 3,941,390 | 3/1976 | Hussy | 273/169 |
| 3,997,170 | 12/1976 | Goldberg | 273/167 C |
| 4,214,754 | 7/1980 | Zebelean | 273/167 H |
| 4,624,460 | 11/1986 | Murase et al. | 273/169 |
| 4,732,389 | 3/1988 | Kobayashi | 273/169 |
| 4,826,172 | 5/1989 | Antonious | 273/167 H |
| 4,828,265 | 5/1989 | Antonious | 273/169 |
| 5,004,241 | 4/1991 | Antonious | 273/167 H |

FOREIGN PATENT DOCUMENTS

| | | | |
|---|---|---|---|
| 20069 | of 1901 | United Kingdom | 273/169 |
| 7287 | of 1908 | United Kingdom | 273/169 |
| 164609 | 6/1920 | United Kingdom | 273/167 B |
| 192025 | 1/1923 | United Kingdom | 273/169 |

*Primary Examiner*—Theatrice Brown
*Assistant Examiner*—Steven B. Wong
*Attorney, Agent, or Firm*—Nicholas J. Aquilino

[57] ABSTRACT

A metal wood type golf club head having an improved inner weighting system within the club head shell for repositioning the center of gravity upwardly and forwardly, including a first mass located behind or adjacent to the center of percussion on the ball striking face and a second mass located on the underside of the upper surface of the club head shell between the ball striking face and rear surface in a front to rear direction.

9 Claims, 5 Drawing Sheets

METAL WOOD GOLF CLUB HEAD WITH IMPROVED WEIGHTING SYSTEM

BACKGROUND OF THE INVENTION

The present invention relates to a golf club head weighting system, and in particular to a metal wood type golf club head having an integrally formed weight structure within the club head cavity adjacent the top surface thereof and directly behind the top surface thereof.

Metal wood golf club heads formed by a light weight durable metal shell having a hollow interior currently enjoy a high level of popularity compared with conventional wood type club head designs. Metal wood heads have been known for a number of years, as evidenced by the 1926 United States patent to Dunn U.S. Pat. No. 1,568,888 and the Australian patent to Cate 211,781 of 1957.

In order to improve the ball striking characteristics of these type golf club heads, there have been a number of efforts made to redistribute the weight to maximize energy transfer to the golf ball as it is struck with the club head. For example, it has been found by moving the weight from the bottom surface of the club head toward the top surface, a club can cause a golf ball to be hit at a lower trajectory to the ground by imparting top spin or overspin. This is particularly favorable in windy conditions or on golf courses where a great deal of run would be favorable once a ball hits the ground. Placement of the weight near the upper portion of the club head increases the stability of the club head as it is swung, and at impact by raising the center of percussion (CP) and/or center of gravity (CG) toward the upper portion of the club head to produce performance characteristics outlined hereinabove.

The present invention is directed to a hollow metal wood golf club head having an internal weighted mass directly under and integrally formed with the underside of the upper section of the club head shell which is combined with another mass placed directly behind or adjacent the center of percussion (CP) on the ball striking face. The upper mass extends in a longitudinal direction from a point adjacent the forward end of the club head shell to a second point adjacent the rear of the club head and is preferably centrally disposed relative to the ball striking face; that is, it is above and behind the center of percussion (CP) on the ball striking face. The other mass takes the form of an increased ball striking face thickness which extends rearwardly within the cavity or shell of the club head to further increase the mass of the club head at this point.

Other embodiments call for masses placed on opposite sides and adjacent to the center of percussion (CP) located specifically at the heel and toe areas, respectively, and/or an aligned mass on the rear inner surface of the club head.

Among the objects of the present invention are the provision of a metal wood type golf club head having an improved internal weighting system wherein the weight is located adjacent the upper areas within the metal shell of the club head and wherein another additional weight mass is located behind or adjacent the ball striking face to increase the energy transfer from the club head to a ball being struck as the club is swung.

Another object is the provision of a metal wood type golf club head which provides a weight distribution system enabling a golfer to control the direction and height of a struck golf ball, thereby providing maximum playability, particularly in adverse or windy conditions. These and other objects will become apparent from the following specification and drawings.

DESCRIPTION OF THE PREFERRED EMBODIMENTS

Figure 1:
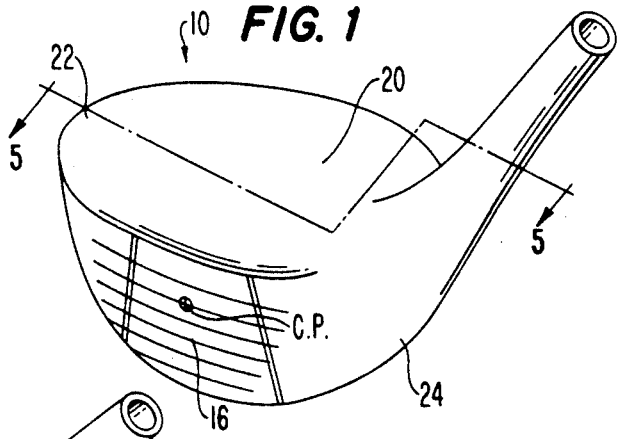
FIG. 1 is a front perspective view of a metal wood type golf club head of the present invention.

Referring to FIGS. 1 to 6 of the drawings, a metal wood type golf club head 10 is shown having a unique weight configuration including a first mass 12 formed within the cavity 14 of the club head 10 directly behind the ball striking face 16 in combination with a second mass 18 provided on the underside of the top surface 20 of the hollow club head 10 and extending in a longitudinal direction from the front to rear of the club head. This unique weight configuration repositions overall center of gravity (CG) upwardly and forwardly on the club head.

Figure 2:
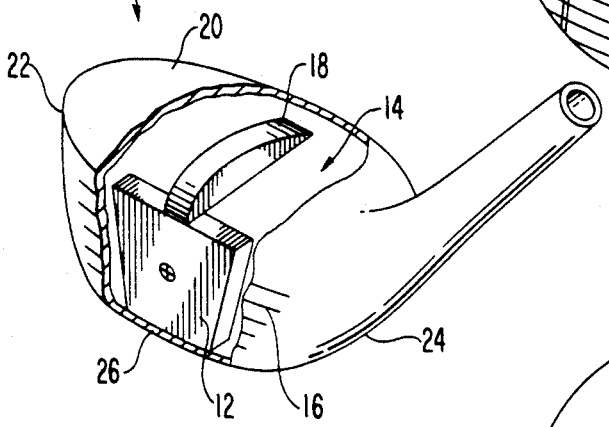
FIG. 2 is a front perspective view, partially in section, of the metal wood golf club head of FIG. 1 pictorially showing the internal weight configuration in accordance with the present invention.
Figure 3:
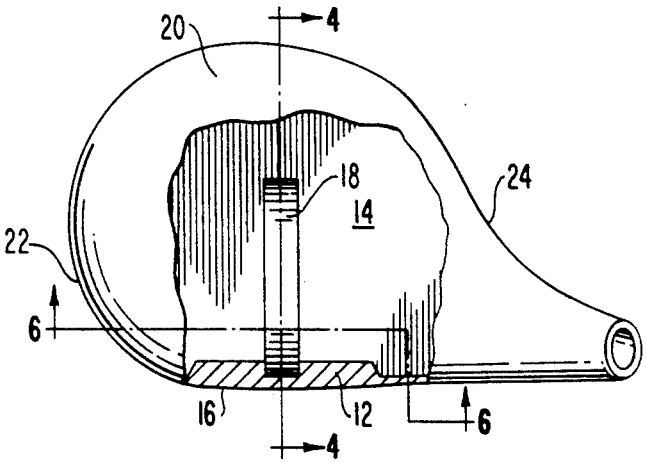
FIG. 3 is a to plan view of the club head of FIG. 1 partially in section.
Figure 5:
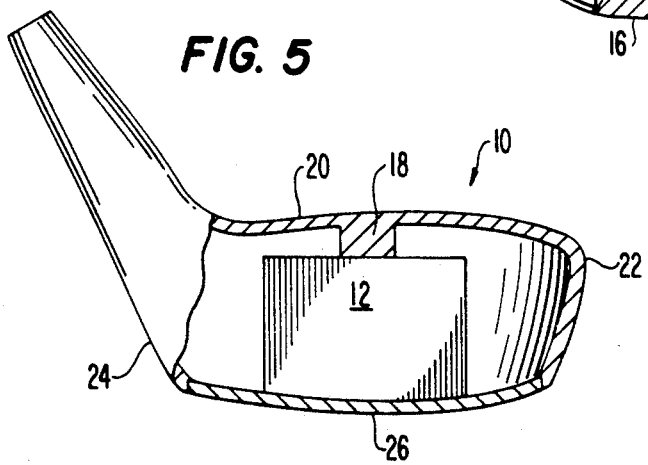
FIG. 5 is a rear elevational view partially in section taken along the lines 5—5 of FIG. 1.
Figure 4:
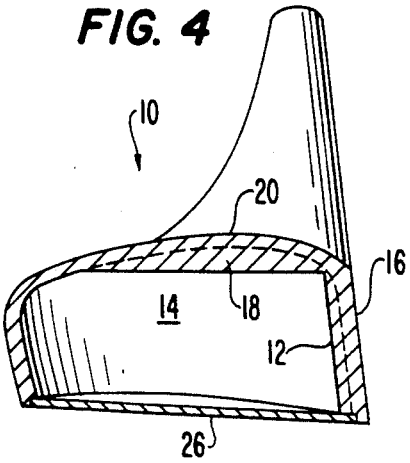
FIG. 4 is a side sectional view taken along the lines 4—4 of FIG. 3.

FIG. 2 illustrates a pictorial view of the weighting system with the adjacent outer portions of the shell of the club head body cut away. It will be appreciated that preferably, the additional masses 12 and 18 are integrally formed as a specifically required and positioned increase in the thickness of the outer shell of the club head 10, the additional thickness being two to three times the overall thickness of the shell which forms the club head as shown in the plan view of FIG. 3. Preferably, the mass 12 is located directly behind the ball striking face and is located approximately halfway between the toe 22 and heel 24 of the club head. The mass 12 also extends from the bottom 26 to adjacent the top surface 20, or in other words, behind the area defined on the front of the club head generally known as the ball striking face 16. The second mass 18 extends approximately one-half to two-thirds of the distance between the front and rear of the club head.

Figure 6:
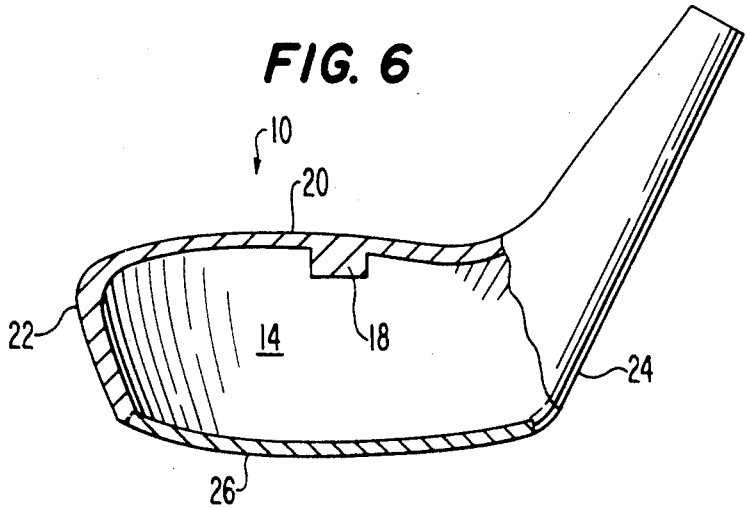
FIG. 6 is a front elevational view partially in seciton along the lines 6—6 of FIG. 3.

As seen particularly in FIG. 6, the second mass 18 takes the form of a keel on the inner underside of the top surface 20 of the club head 10 and adds weight above the point on the ball striking face known as the center of percussion (CP) where maximum energy is transferred to a ball being struck. This second mass 18 causes a top spin to be imparted to the ball and this tends to keep the ball flight at a lower trajectory, enabling it to run further and to fly farther, particularly in adverse weather conditions. This is a particularly useful quality in wood type golf club heads where maximum distance is generally sought. The first mass 12 relocates a significant amount of the total mass of the club head directly at and just behind the ball striking face where the ball is to be struck promoting maximum energy transfer at that point.

Figure 7:
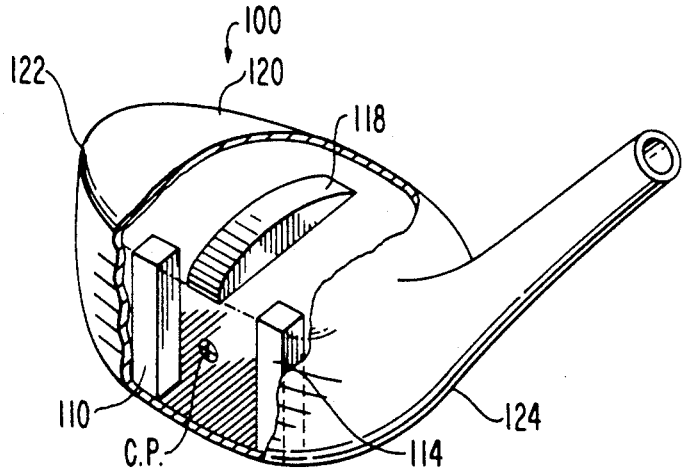
FIG. 7 is a front perspective view, partially in section, of a second embodiment of a metal wood type golf club head with an internal weight configuration in accordance with the present invention.
Figure 8:
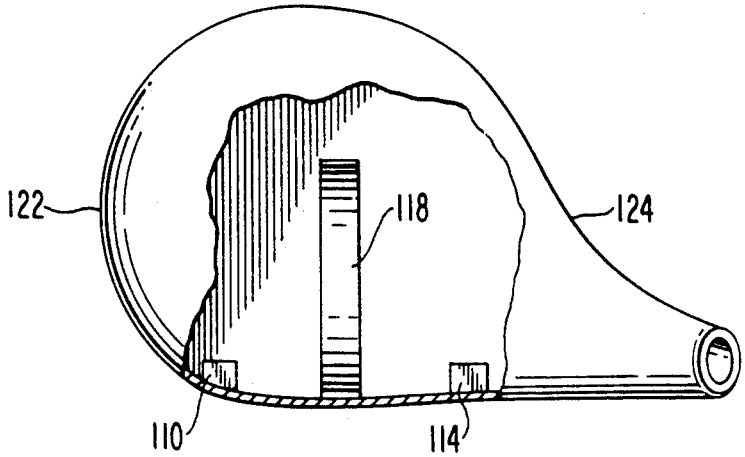
FIG. 8 is a top plan view taken partially in section showing the interior of the club head of FIG. 7.

FIGS. 7 and 8 illustrate a second embodiment of a golf club head 100 of the present invention where the internal weight system takes the form of a first upstanding bar 110 located between the center of percussion (CP), pictorially shown at the ball striking face in FIG. 7, and the toe 122 and a second upstanding mass 114 located between the center of percussion (CP) and the heel 124. A third mass 118 takes the form of a keel on the inner underside of the top surface 120. Again, it will be appreciated that these masses are integrally formed with the outer shell, preferably as additional thicknesses of material at the location shown in the figures. Alternately, the weights may be subsequently added within the interior of a conventional hollow shell club head before the sole plate is affixed.

Figure 9:
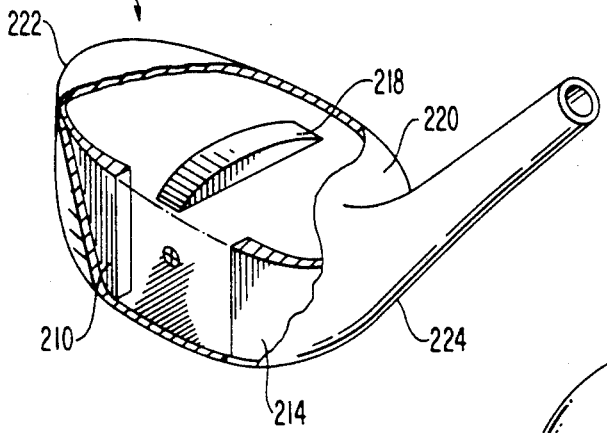
FIG. 9 is a front perspective view, partially in section, of a third embodiment of the present invention.
Figure 10:
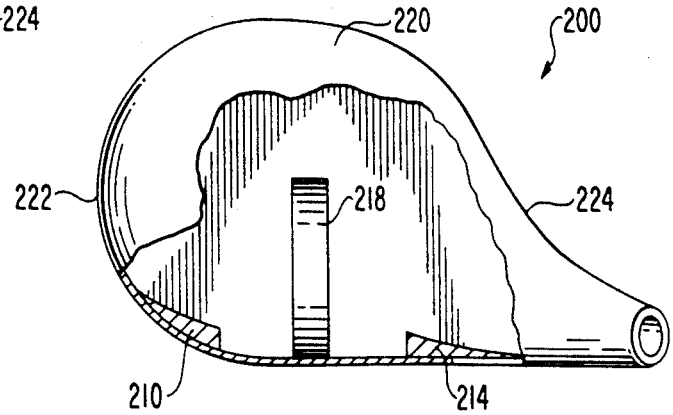
FIG. 10 is a top plan view taken partially in section showing the interior of the club head of FIG. 9.

FIGS. 9 and 10 illustrate a third embodiment of a golf club head 200 of the present invention wherein the internal weight system takes the form of a toe weight 210 located behind the toe 222 portion of the ball striking face and a heel weight 214 located behind the heel 224 portion of the ball striking face. A third mass 218, again in the form of a keel, is located on the underside of the top surface 220 of the club head 200. The heel and toe weights 214 and 210 increase the moment of inertia to obtain maximum performance of a golf ball struck toward the toe or heel portion of the club head, as is commonly known in the golf club art.

Figure 11:
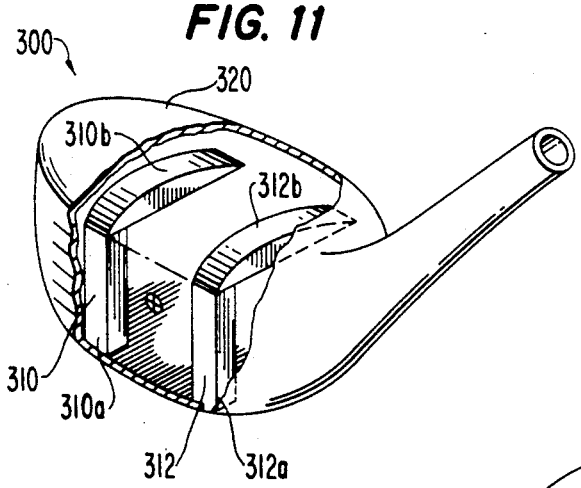
FIG. 11 is a front perspective view, partially in section, of a fourth embodiment of the present invention.
Figure 12:
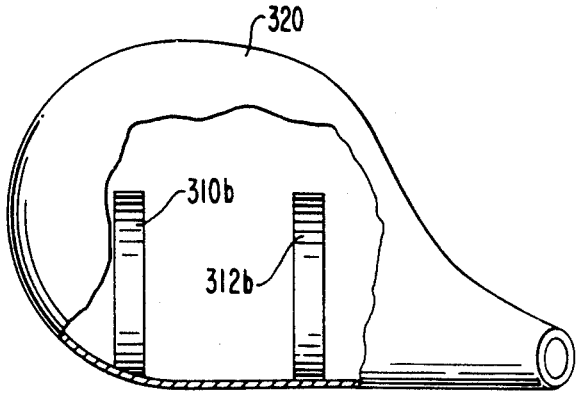
FIG. 12 is a top plan view taken partially in section showing the interior of the club head of FIG. 11.

FIGS. 11 and 12 show a fourth embodiment of a club head 300 of the present invention including a pair of inverted L-shaped masses 310 and 312 which are positioned on either side of the ball striking face.

Each of the masses 310 and 312 is formed of an upstanding vertical section 310*a* and 312*a* and an attached horizontal keel-type section 310*b* and 312*b* integrally formed on the underside of the top surface 320 in the same manner as described with respect to the embodiments described hereinabove. This internal weighting arrangement provides still further heel-toe weighting characteristics to the club head 300 both adjacent to and above the center of percussion (CP).

Figure 13:
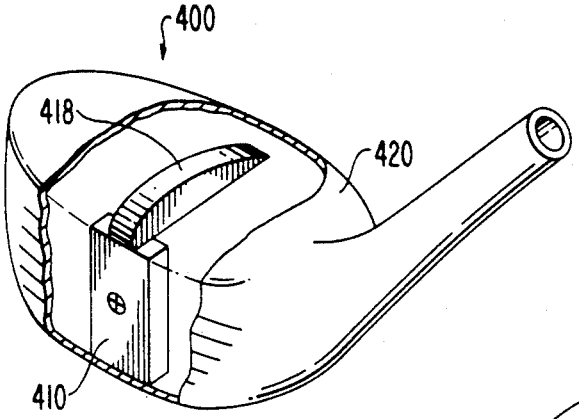
FIG. 13 is a front perspective view, partially in section, of a fifth embodiment of the present invention.
Figure 14:
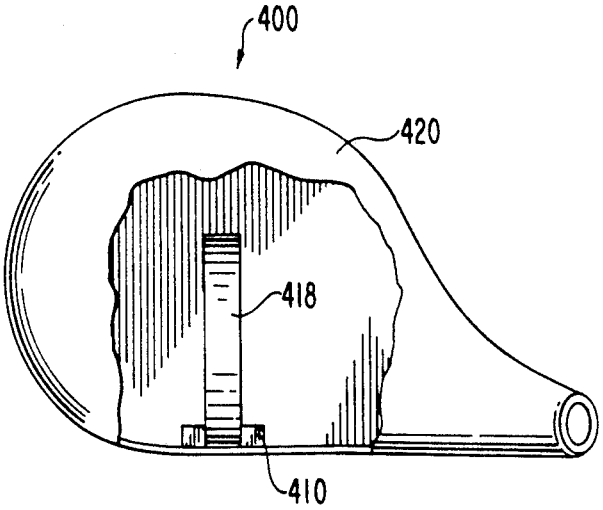
FIG. 14 is a top plan view taken partially in section showing the interior of the club head of FIG. 13.

FIGS. 13 and 14 show a fifth embodiment of a golf club head 400 wherein the internal weight system takes the form of a narrow vertical weight 410 located directly behind the center of percussion (CP) on the ball striking face combined with a keel-type mass 418 located on the inner underside of the top surface 420.

Figure 15:
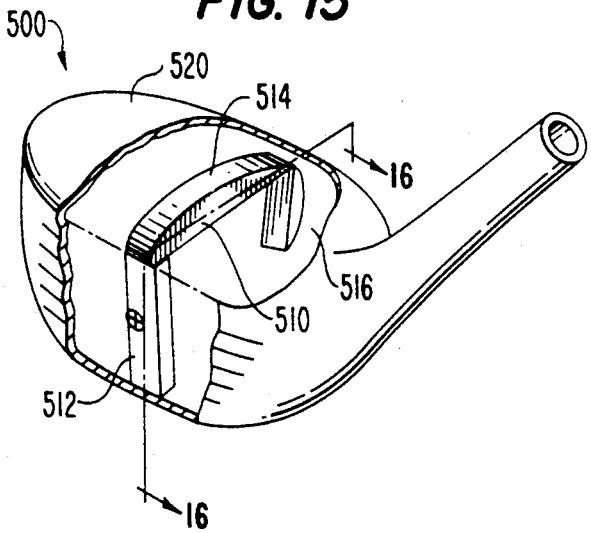
FIG. 15 is a front perspective view, partially in section, of a sixth embodiment of the present invention.
Figure 16:
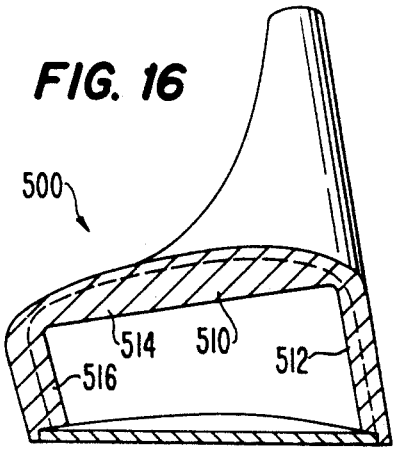
FIG. 16 is a side sectional view taken along the lines 16—16 of FIG. 15.
Figure 17:
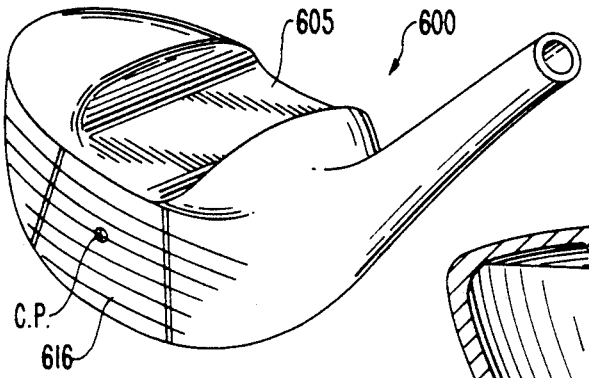
FIG. 17 is a front perspective view of a seventh embodiment of the club head of the present invention.
Figure 18:
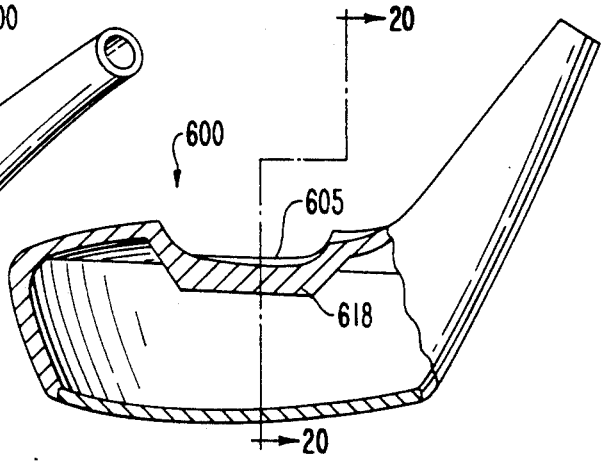
FIG. 18 is a front elevational view, partly in section, of the club head of FIG. 17.
Figure 19:
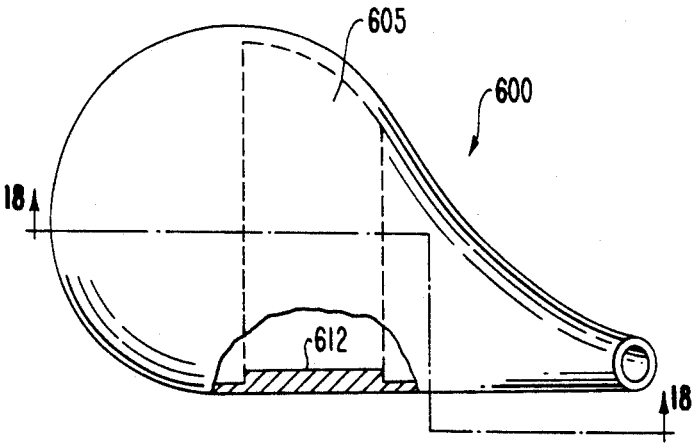
FIG. 19 is a top plan view, partially in section, of the club head of FIG. 17.
Figure 20:
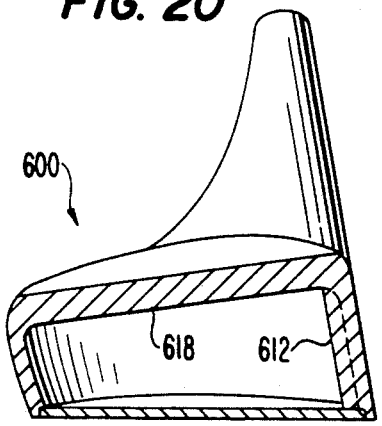
FIG. 20 is a sectional view taken along the lines 20—20 of FIG. 18.

FIGS. 15 and 16 illustrate a sixth embodiment of a golf club head 500 wherein the internal weight system takes the form of an inverted, U-shaped mass 510 including an upstanding front vertical portion 512, a keel-type portion 514 on the underside of the top surface 520 and a rear vertical portion 516. The U-shaped mass 510 wraps-around the interior of the shell which forms the club head 500 acting as an inner brace therefor. In this embodiment, both the front and rear vertical portions 512 and 514 extend the entire distance from the bottom to the top of the club head 500 and the keel-type portion 514 extends the entire distance between the front and the rear of the club head.

FIGS. 17, 18, 19 and 20 show a seventh embodiment of a club head 600 of the present invention. The club head 600 includes an aerodynamic air channel 105 located on the top surface of the club head, which aids in channeling high velocity air across the top of the club face as it is swung and redirecting this high velocity air to the area immediately behind the club head to substantailly increase the low pressure normally occuring at that point, and therefore greatly reducing drag enabling the club to be swung faster. In this embodiment, a primary mass 612 is positioned directly behind the ball striking face and a secondary mass 618 is positioned on the underside of the aerodynamic air channel 605. As with the first embodiment, the masses are formed as thickened walls at the point where they are located, the overall thickness being approximately two to three times the normal wall thickness to create the additional weight.

It will be appreciated that the various embodiments of the internal weighting system may be combined with a golf club head having an aerodynamic slot of the type shown in FIGS. 17 to 20.

It will also be appreciated that various other modifications and changes may be made in the weighting system described hereinabove using a primary mass or masses at or adjacent the center of percussion (CP) on the ball striking face, and a secondary mass located under the top surface of the club head. For example, the invention is not necessarily limited to weight configurations which are plain in design as long as the weights are located in the same general area. Given the above, the invention is therefore defined by the following claims.

I claim:

1. A metal wood type golf club head having a center of gravity and formed of a hollow interior metal shell having inner and outer wall surfaces and a first wall thickness, said club head including a hosel, heel, toe, upper surface on top thereof, rear surface, bottom, and ball striking face on front thereof with a center of percussion thereon wherein the improvement comprises:

means for positioning said center of gravity upwardly and forwardly on the golf club head;

said means including a first elongated mass integrally formed with said inner wall surface and under said upper surface and extending beyond said inner wall surface into the interior of said metal shell, said elongated mass located between a point adjacent said ball striking face and a second point adjacent said rear surface in a front-to-rear direction;

said elongated mass and said metal shell having a second thickness at least twice the thickness of said first wall thickness, said elongated mass centrally disposed relative to the ball striking face between said hell and said toe; and, a second mass located behind and adjacent said ball striking face and being oriented relative to said upper surface in a top-to-bottom direction; said second mass and said metal shell having a third thickness at least twice the thickness of said first wall thickness.

2. The golf club head of claim 1 wherein said first elongated mass extends partway between aid ball striking face and said rear surface.

3. The golf club head of claim 1 wherein aid elongated mass extends the entire distance between said ball striking face and said rear surface.

4. The golf club head of claim 3 further including an additional mass located on said rear surface extending in a top-to-bottom direction.

5. The golf club head of claim 1 wherein said club head is further characterized by an aerodynamic air channel formed in said top surface extending between said ball striking face and said rear surface in a front to rear direction.

6. The gold club head of claim 1 wherein said first elongated mass and said second mass are oriented at approximately 90 degrees, each with respect to the other.

7. A metal wood type golf club head having a center of gravity and formed of a hollow interior metal shell having inner and outer wall surfaces and a first wall thickness, said club head including a hosel, heel, toe, upper surface on top thereof, rear surface, bottom, and ball striking face on front thereof with a center of percussion thereon wherein the improvement comprises:

means for positioning said center of gravity upwardly and forwardly on the golf club head;

said means including a first elongated mass integrally formed with said inner wall surface and under said upper surface and extending beyond said inner wall surface into the interior of said metal shell, said elongated mass located between a point adjacent said ball striking face and a second point adjacent said rear surface in a front-to-rear direction;

said elongated mass and said metal shell having a second thickness at least twice the thickness of said first wall thickness, said elongated mass centrally disposed relative to the ball striking face between said heel and said toe; and, second and third masses located within said metal shell and behind and adjacent said ball striking face and spaced each from the other on either side of a point opposite said center of percussion, said second and third masses being oriented relative to said upper surface in a top-to-bottom direction; said second and third masses and said metal shell having a third thickness at least twice the thickness of said first wall thickness.

8. The golf club head of claim 7 wherein said second and third masses are located, one adjacent said toe and a second adjacent said heel on either side of said ball striking face.

9. The golf club head of claim 7 wherein said second and third masses are rectangular in shape.

* * * * *